US005289754A

United States Patent [19]

Elspass

[11] Patent Number: 5,289,754

[45] Date of Patent: Mar. 1, 1994

[54] REDUNDANT AMMUNITION FLOW DEVICE

[75] Inventor: Marold Elspass, Kaarst, Fed. Rep. of Germany

[73] Assignee: Rheinmetall GmbH, Dusseldorf, Fed. Rep. of Germany

[21] Appl. No.: 872,095

[22] Filed: Apr. 22, 1992

[30] Foreign Application Priority Data

May 10, 1991 [DE] Fed. Rep. of Germany ..... 4115283

[51] Int. Cl.[5] ..... F41A 9/16

[52] U.S. Cl. ..... 89/46; 89/33.04

[58] Field of Search ..... 89/45, 46, 47, 33.14, 89/33.04, 33.05, 6.5

[56] References Cited

U.S. PATENT DOCUMENTS

| | | | |
|---|---|---|---|
| 2,642,778 | 6/1953 | Campbell et al. | 89/6.5 |
| 2,997,923 | 8/1961 | Kempton | 89/33.14 |
| 4,388,854 | 6/1983 | Dabrowski et al. | 89/46 |
| 4,454,799 | 6/1984 | Gilvydis | 89/47 |
| 4,860,633 | 8/1989 | Wiethoff et al. | 89/45 |

FOREIGN PATENT DOCUMENTS

| | | | |
|---|---|---|---|
| 141900 | 5/1985 | European Pat. Off. | 89/46 |
| 275371 | 7/1988 | European Pat. Off. | 89/46 |
| 3642920 | 6/1988 | Fed. Rep. of Germany | 89/46 |
| 3725762 | 2/1989 | Fed. Rep. of Germany | 89/46 |
| 11461 | of 1897 | United Kingdom | 89/46 |
| 2200195 | 7/1988 | United Kingdom | 89/45 |

*Primary Examiner*—Stephen M. Johnson
*Attorney, Agent, or Firm*—Spencer, Frank & Schneider

[57] ABSTRACT

A redundant ammunition flow device for supplying divided, large caliber ammunition to a loading tray of a gun mounted on a turret of a vehicle for adjustment in elevation about a trunnion includes at least two magazines disposed in the vehicle chassis. Each magazine is a closed loop and includes a plurality of first holders that accommodate in an upright position either a projectile or a propelling charge column which make of the ammunition. A guide formed of a ring segment is fixed to the chassis concentric with the turret rotation axis. Two ammunition transporters are mounted for displacement on the guide to receive at a respective transfer position either a projectile or a propelling charge column from the first holders. Each transporter includes a rotary arm carrying a feed arm supporting second holders for holding a projectile or a propelling charge column. Two ammunition transfer arms are arranged, one on each side of the gun, for receiving either a projectile or a propelling charge column from one of the ammunition transporters. Each ammunition transfer arm is pivotal about the trunnion and includes a lifting arm having third holders for picking up and lifting a projectile or propelling charge column. Two readiness trays are arranged, one on each side of the loading tray, for receiving either a projectile or propelling charge column from one of the ammunition transfer arms.

11 Claims, 7 Drawing Sheets

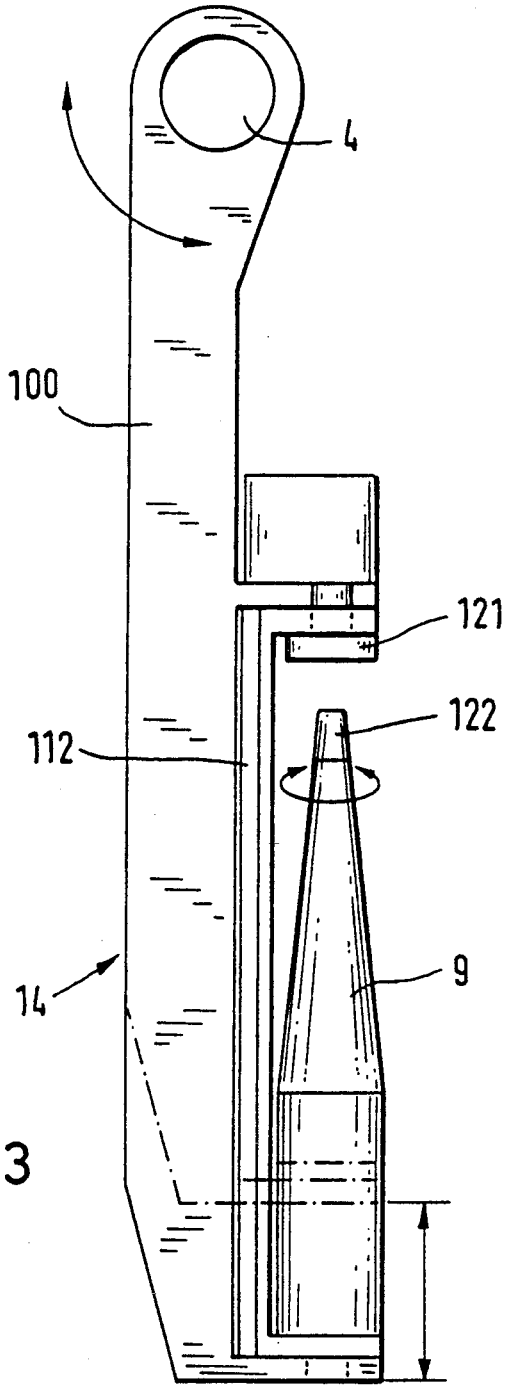
FIG.3
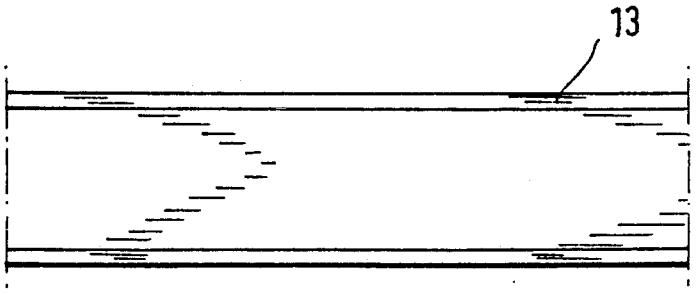

REDUNDANT AMMUNITION FLOW DEVICE

BACKGROUND OF THE INVENTION

The present invention relates to a redundant ammunition flow device for supplying divided, large caliber ammunition in a magazine in the chassis of a vehicle to the loading tray of a weapon that is disposed in a turret of the vehicle so as to be adjusted in elevation about a trunnion.

U.S. Pat. No. 4,860,633 discloses a magazine for undivided ammunition in the turret of a tank in which holders arranged in a rotating loop receive the ammunition in an upright position. The ammunition is automatically removed from the magazine and fed by means of a transfer device to the gun, which is not yet adjusted in elevation. However, this system is not suitable for ammunition that is divided into projectiles and propelling charges.

SUMMARY OF THE INVENTION

It is an object of the present invention to provide an ammunition flow device of the type first described above which is redundant and ensures a reliable and rapid ammunition supply with optimum space utilization.

The above and other objects are accomplished in accordance with the invention by the provision of a redundant ammunition flow device for supplying divided, large caliber ammunition, composed of a projectile and a propelling charge column, including a plurality of propelling charge modules, to a loading tray of a gun that is mounted on a turret of a vehicle for adjustment in elevation about a trunnion, the vehicle having a chassis, comprising: at least two magazines disposed in the chassis of the vehicle, each magazine having a form of a closed loop and including a plurality of first holders that are adapted to accommodate in an upright position either one of the projectiles or one of the propelling charge columns and that can be placed, respectively, in a transfer position; a lower guide having a form of a ring segment and fixed to the chassis so that the lower guide is concentric with an axis of rotation of the turret; two ammunition transporters mounted for displacement on the guide each for receiving at a respective transfer position either a projectile or a propelling charge column from a respective one of the first holders, each transporter including a first rotary arm and a feed arm held by the first rotary arm and including second holders for holding the projectile or the propelling charge column; two ammunition transfer arms operatively arranged for receiving either a projectile or a propelling charge column from a respective one of said ammunition transporters, one ammunition transfer arm disposed on each side of the gun and each ammunition transfer arm being pivotal about the trunnion and including a lifting arm having third holders for picking up and lifting the projectile or propelling charge column; and two readiness trays operatively arranged for receiving either a projectile or propelling charge column from a respective one of the ammunition transfer arms, with one of the readiness trays being disposed on each side of the loading tray.

In such an ammunition flow device, the divided ammunition is received in appropriate magazines in a space saving manner and is automatically removed from the magazines and loaded without the need for human intervention into the gun which is equipped with a loading device including two loading mechanisms, for example a flick rammer for the projectiles and a chain rammer for the propelling charges. A human being is normally not in the combat chamber, except for emergency operations. The transporting devices which, if need be, may also operate individually, are also space saving since the ammunition is transported and transferred in an upright orientation.

Due to the redundancy, reliability and thus combat readiness of the weapon are increased. The division into preferably four magazines ensures high availability of the ammunition components since combat missions can be fulfilled even if there is a partial malfunction. Moreover, the masses to be moved are reduced considerably by this arrangement.

In this connection it is advisable for the magazines to be arranged symmetrically to the center longitudinal axis of the vehicle. Moreover, the magazines may be configured as elongate loops arranged parallel to the center longitudinal axis of the vehicle. The magazines may alternatingly be equipped with identical holders for projectiles and for columns of propelling charges. Advisably four magazines are provided.

The ammunition transporters may include a carriage that is guided by a guide member. The ammunition transporters may be provided with a running head at their top end which is in engagement with an upper ring segment shaped guide member that in turn may be connected with the race ring flange of the turret by way of holding arms. The ammunition transporters each include a rotary arm and a feed arm which may be guided horizontally relative to the rotary arm by way of guide sleeves which accommodate guide rods of the feed arm. The rotary arm may be arranged rotatably on the carriage and the rotary arm may carry the running head that runs below the holding arm which connects the upper ring segment to the turret race ring flange relative to the rotary arm. The ammunition transfer arm may include a holding arm which is rotatable about the trunnion by way of a toothed segment, with a lifting arm being longitudinally displaceable relative to the holding arm by way of toothed rods.

The lifting arm may carry a fuse setting coil which may be arranged at the lifting arm to be adjustable in height corresponding to the height of the projectile.

The ends of the lifting arm may accommodate a rotary arm which is arranged so as to be rotatable relative to the lifting arm of the ammunition transfer arm.

The holders of the magazines, of the feed arm of the ammunition transporter arms, and of the rotary arms of the ammunition transfer arms may be provided with clamp holders for all propelling charge modules of a propelling charge column. The clamp holders may each include a holding clamp adjustable radially to the ammunition and a holding clamp that is pivotal toward the ammunition. The clamp holders may be actuated by way of lifting magnets. The clamp holders surround the ammunition preferably over an angle greater than 180°. The clamp holders may be locked mechanically in the ammunition holding position. The movable holding clamp may be pivotal by way of a lifting magnet rod whose lifting magnet is mounted by means of a pin in a long hole that extends obliquely to the lifting magnet rod, with the lifting magnet rod carrying a securing pin which can be brought into engagement with play in a claw that is pivotally articulated to the holding clamp under the tension of a spring. Advisably, all holders can be actuated individually.

Further features of the invention will be found in the description that follows.

The invention will now be described in greater detail with reference to an embodiment that is illustrated in the attached drawing figures.

BRIEF DESCRIPTION OF THE DRAWINGS

FIG. 3 is a schematic representation of an ammunition transfer arm in accordance with the invention.

DETAILED DESCRIPTION OF PREFERRED EMBODIMENTS

Figure 1:
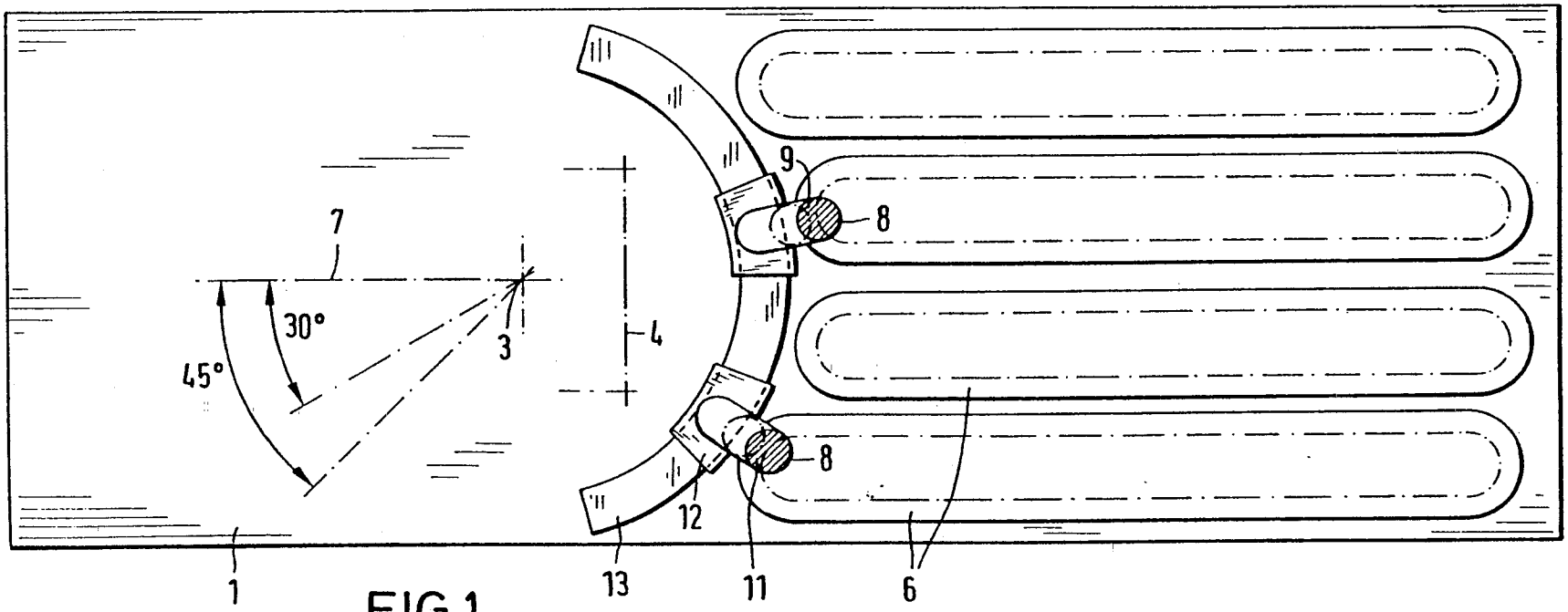
FIG. 1 is a schematic top view of the chassis of an armored vehicle, preferably an armored howitzer, and shows the arrangement of the magazines and the removal therefrom in accordance with the invention.
Figure 4:
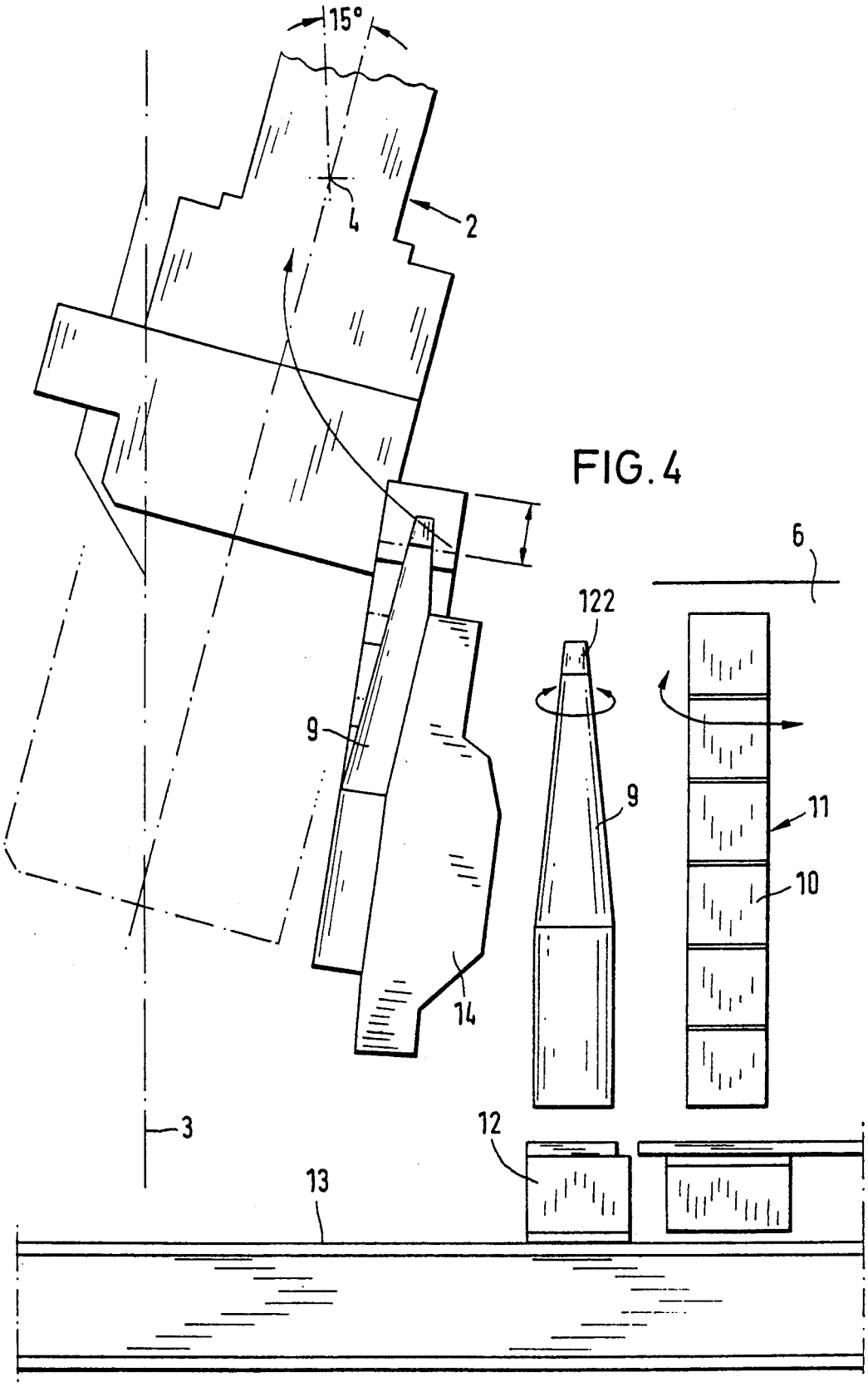
FIG. 4 is a schematic representation showing the transfer of ammunition to the weapon in accordance with the invention.

Referring to FIG. 1, there is shown a chassis 1 of an armored vehicle, for example an armored howitzer, including a non-illustrated turret which is equipped with a gun 2 (see FIG. 4) and is rotatable about a vertical turret rotation axis 3, while gun 2 is pivotal about the horizontal axis 4 of a trunnion 5 (see FIGS. 3 and 7) provided in gun 2.

According to the illustrated embodiment, chassis 1 includes four juxtaposed magazines 6 each of which is composed of an elongate closed loop having elongate sections that are parallel to one another and parallel and symmetrical to the longitudinal vehicle axis 7. Magazines 6 are disposed behind the drive and the combat chamber of the vehicle at the tail of chassis 1. Each magazine 6 includes a plurality of holders 8, not shown in detail, that are guided at the top and bottom, are provided with a stand-up surface and holding clamps and accommodate upright projectiles 9 or propelling charge columns 11 composed, for example, of six propelling charge modules 10 (see FIG. 4). If required, holders 8 may also be configured to selectively receive projectiles 9 as well as propelling charge columns 11. In particular, projectiles 9 and propelling charge columns 11 are arranged alternatingly within each magazine in any sequence, but they may also be divided into different magazines, one with charges, one with projectiles The magazine drive is effected by way of chains (not shown) that engage at the holders 8 which are guided at the top and bottom and are in engagement with an associated magazine drive (not shown) disposed underneath the respective magazine 6.

Two ammunition transporters 12, are guided at the top and bottom within a turret pivot range of ±30°, within which arc the turret can traverse. Both transporters 12 operate on a lower guide in the form of a ring segment 13 that is fixed to chassis 1 and on an upper guide in the form of another ring segment 62 that is connected to a race ring 68 of the turret by a holding arm 66 (see FIG. 6) as described in more detail below. The two ammunition transporters 12 each work with two magazines 6 to accommodate and further transport projectiles 9 and propelling charge columns 11 as a whole or only a required number of propelling charge modules 10, alternating from the right and left. If necessary, one ammunition transporter 12 may also transport projectiles 9 as well as propelling charge columns 11 (at a slower cadence) if one ammunition transporter 12 is malfunctioning.

Figure 2:
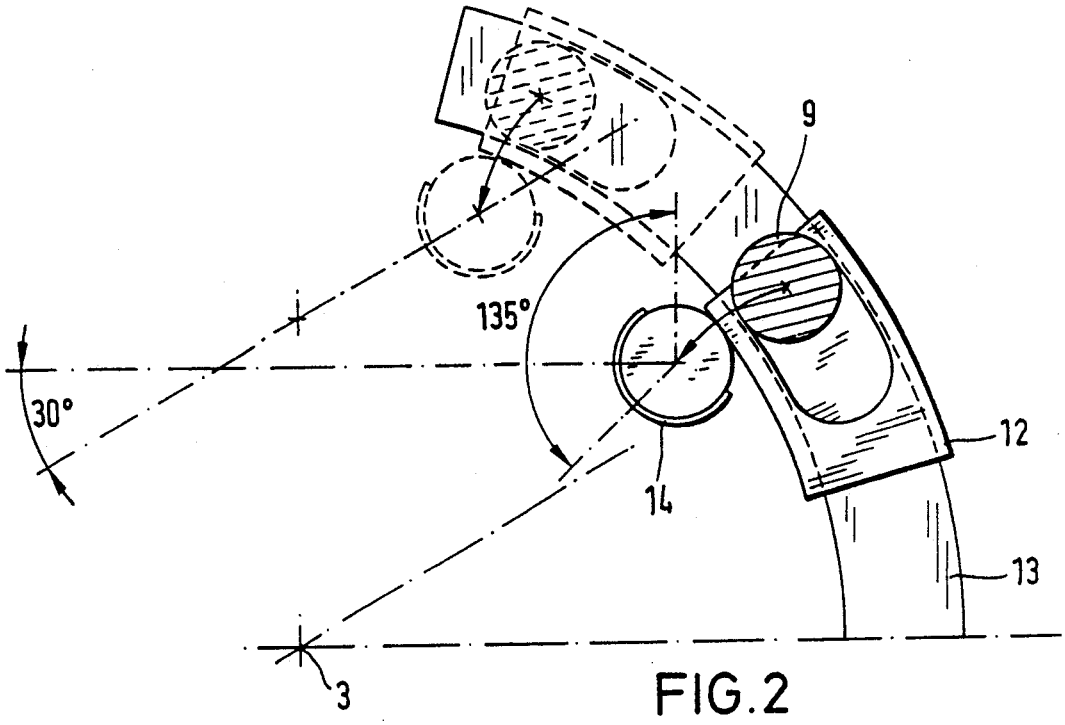
FIG. 2 is a schematic representation showing the transfer of ammunition from an ammunition transporter to an ammunition transfer arm in accordance with the invention.

As can be seen in FIGS. 2 and 3, an ammunition transfer arm 14 is disposed at each side of gun 2 and pivotally connected at trunnion 5 of the gun to take over the ammunition brought in by ammunition transporter 12. For this purpose, ammunition transporter 12 moves the ammunition on an essentially rectangular path (FIG. 2) into the region of an ammunition transfer arm 14 and deposits it thereon.

Figure 5:
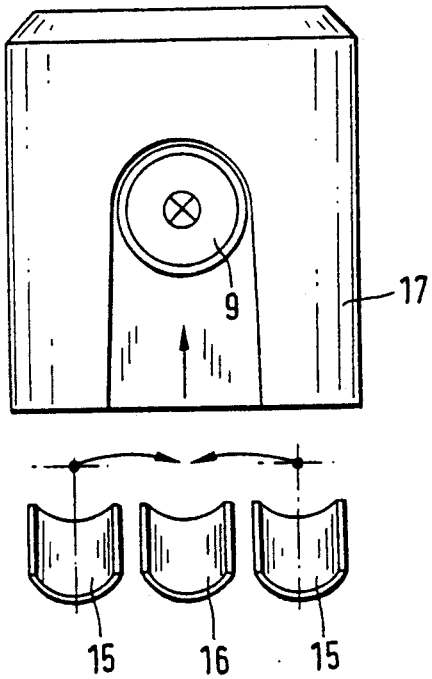
FIG. 5 is a schematic illustration showing the loading of the weapon in accordance with the invention.

On ammunition transfer arms 14 the ammunition is rotated 135° as soon as the former start moving to elevate the ammunition. Ammunition transfer arms 14 pivot about trunnion 5 and additionally lift the ammunition in the longitudinal direction of the ammunition transfer arm to the required height (see FIGS. 3 and 7) in order to deposit the ammunition on one of two readiness trays 15 (FIG. 5) on a cradle extension of gun 2. The ammunition is then transferred in its 135° rotated position laterally to the readiness trays 15.

From readiness tray 15, projectile 9 is moved to a loading tray 16 of a flick rammer and is rammed into the gun barrel of gun 2. The propelling charge modules 10 disposed on the other readiness tray 15 are then moved onto loading tray 16 in front of a chain rammer to be activated and are moved into the loading position and loaded, whereupon the wedge of the breechblock 17 of the gun closes. If necessary, when an entire propelling charge column 11 is being employed, the latter is pushed backward by a device (not shown) on loading tray 76 so that there is sufficient freedom of movement between it and the rear edge of the gun barrel when loading tray 16 is pivoted upwards.

The automatic flow of ammunition starts with the movement of projectiles 9 and propelling charge columns 11 in magazines 6 to the transfer position and to ammunition transporters 12. The latter are disposed in the transfer positions at the selected magazines 6. An ammunition transporter 12 takes a projectile 9 from one magazine 6, the other takes the desired number of propelling charge modules 10 (counting from the bottom in propelling charge column 11) from another magazine 6 on the opposite side of the vehicle relative to longitudinal axis 7 of the vehicle. The removed projectile 9 and the associated propelling charge modules 10 are rotated into the transporting position on the respective ammunition transporter 12 and are moved on the path of ring segment 13 into the azimuth position of gun 2 in which ammunition transfer arms 14 are pivoted downward into the transfer position. Ammunition transporters 12 transfer projectile 9 and propelling charge modules 10 to ammunition transfer arms 14 which in turn transfer them to readiness trays 15.

During the transporting movement of the ammunition transporters 12, the next projectile 9 and the next propelling charge column 11 are moved into the respective transfer position of the respective magazine 6.

While ammunition transfer arms 14 move toward gun 2, ammunition transporters 12 move on ring segment 13 to the transfer positions at magazines 6. While projectile 9 and propelling charge column 11 are on readiness trays 15, ammunition transfer arms 14 pivot downward into the position for receiving an ammunition component from one of ammunition transporter arms 12.

Figure 6:
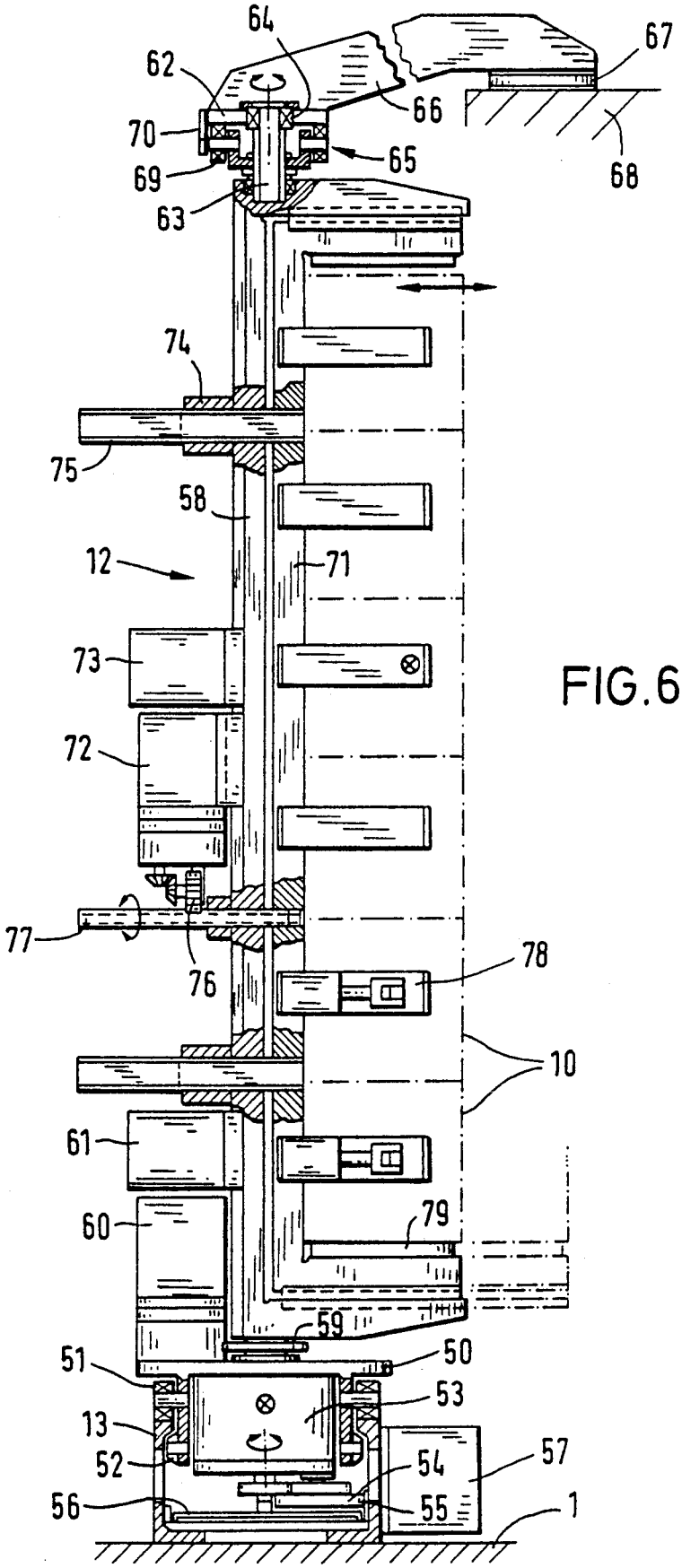
FIG. 6 is a side view of an ammunition transporter in accordance with the invention.

The ammunition transporter 12 according to FIG. 6 includes a carriage 50 that is provided at each one of two oppositely disposed sides with two rollers 51 which run on the upper edge of ring segment 13 whose cross section is Cshaped. Additionally, the transporter is equipped with two support rollers 52 in the form of bevel gears that mesh with the inner edges of ring segment 13. Below carriage 50 there is also flanged on a drive unit 53 (motor, coupling, connected gear assembly) which drives a pinion 54 that is in engagement with a toothed arc 55 extending along an interior face of ring segment 13, with a central lateral guide wheel 56 that serves to guide carriage 50 in ring segment 13 being arranged coaxially with the drive shaft of drive unit 53. The movement of carriage 50 is controlled by way of a control unit 57 disposed at ring segment 13 or at carriage 50.

Carriage 50 supports a vertical rotary arm 58 whose lower end is disposed so as to rotate on carriage 50 and is there provided with a ring of teeth 59 that meshes with a rotary drive 60 (motor, coupling, gear assembly) mounted on carriage 50. In order to control its rotary movement, rotary arm 58 is equipped with a control unit 61.

An upper ring segment 62 is provided to guide the upper end of rotary arm 58. A running head 65 of rotary arm 58, is equipped with a guide wheel 64 disposed on a shaft 63 that is rotatably supported in rotary arm 58. Ring segment 62 is connected with the race ring flange 68 of the turret by way of holding arms 66 and a resilient compensation member and is thus fixed relative to ring segment 13. Running head 65 additionally carries four running wheels 69 which have a horizontal shaft and are in engagement with the corresponding running faces of ring segment 62. A securing metal part 70 that acts against possible canting of running head 65 is also provided at ring segment 62.

Ammunition transporter 12 is additionally provided with a feed arm 71 that is horizontally guided relative to rotary arm 58, a drive unit 72 (motor, coupling, gears), a control unit 73 as well as horizontal guide sleeves 74 attached to rotary arm 58. Guide sleeves 74 accommodate guide tubes 75 fixed to feed arm 71 for the horizontal guidance of feed arm 71, while drive unit 72 includes a pinion 76 that is in engagement with a drive spindle 77 of feed arm 71 guided so as to displace feed arm 71 horizontally relative to rotary arm 58.

Feed arm 71 is equipped with clamp holders 78 in a number corresponding to the number of propelling charge modules 10 disposed in a propelling charge column 11 so that it is able to individually grip each propelling charge module 10 in a propelling charge column 11 as well as to grip a projectile 9. The feed arm also includes a lower stand-up plate 79. Clamp holders 78 can be pivoted away and toward one another individually by way of appropriate electromechanical actuation devices (not shown) and can be locked in their respective positions. Thus, once rotary arm 58 has been rotated correspondingly and feed arm 71 has been extended, a projectile 9 disposed in a holder 8 in a magazine 6 can be gripped by means of all clamp holders 78 or a desired number of propelling charge modules 10 disposed in a holder 8 in a magazine 6 can be gripped by means of a corresponding number of clamp holders 78. After feed arm 71 has been retracted, the projectile or propelling charges can be transported by means of ammunition transporter 12.

Figure 7:
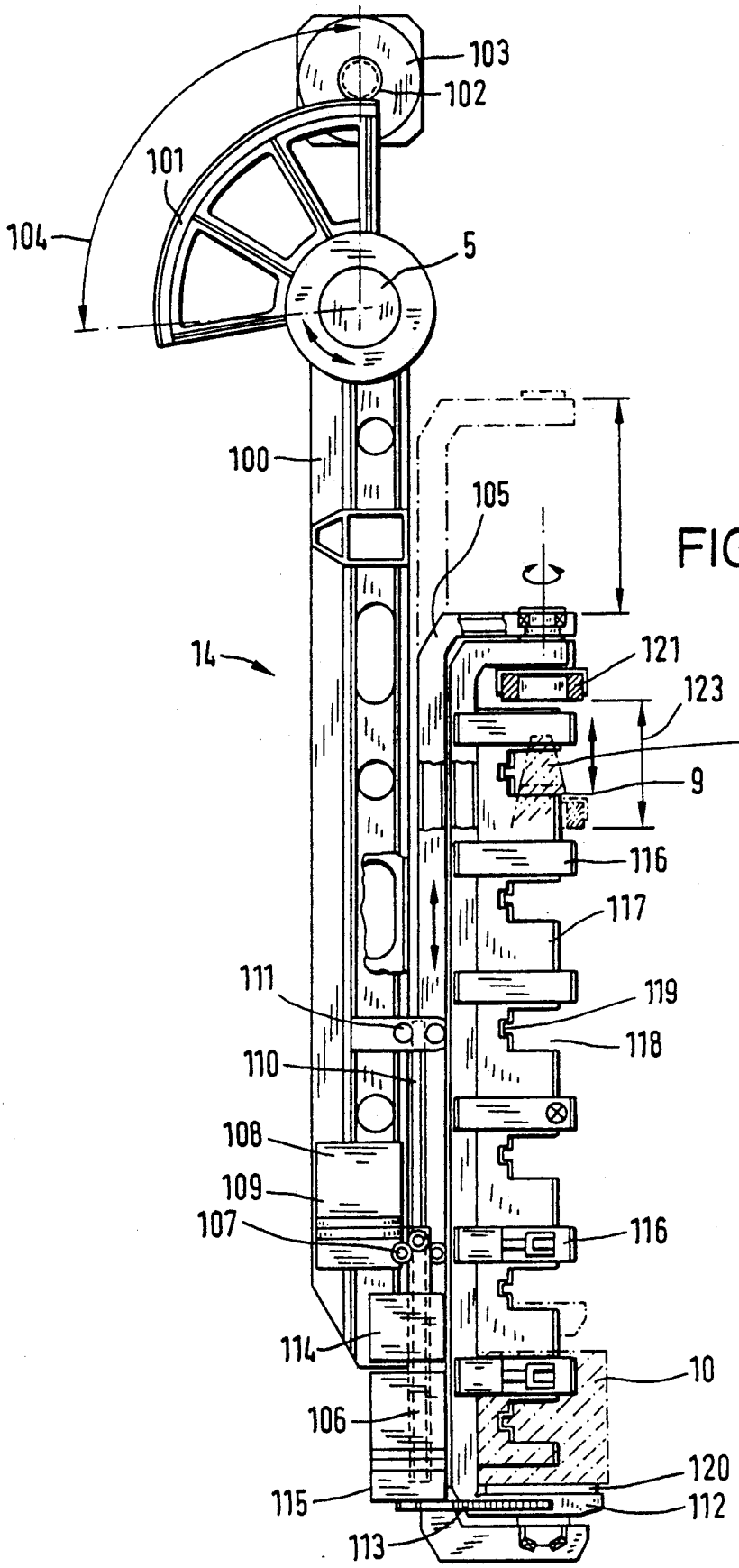
FIG. 7 is a side view of an ammunition transfer arm in accordance with the invention.

The ammunition transfer arm 14 according to FIG. 7 includes a holding arm 100 which is arranged to rotate about trunnion 5 and is equipped with a toothed segment 101 whose pinion 102 is in engagement with a correspondingly controlled drive unit 103 (motor, coupling brake and gears) for pivoting ammunition transfer arm 14 (the elevation angle of gun 2 being marked 104).

Holding arm 100 carries a lifting arm 105 which is provided with a toothed rod 106 on either side, each in engagement with two pinions 107 which are in turn driven by a drive unit 109 (motor, coupling, gears) disposed at holding arm 100 and controlled by a control unit 108 to adjust the longitudinal direction of lifting arm 105 relative to holding arm 100. Lifting arm 105 is further provided with slide faces 110 that are fixed to the lifting arm which, in the illustrated embodiment, constitute an extension of toothed rods 106 and are in engagement with guide rollers 111 disposed at holding arm 100.

Lifting arm 105 accommodates a rotary arm 112 at both its ends. Rotary arm 112 is provided with a toothed segment 113 that is in engagement with a drive unit 115 (motor, coupling, gears) controlled by a control unit 114. Rotary arm 112 is further equipped with a series of clamp holders 116 corresponding to the number of propelling charge modules 10 available in a propelling charge column 11, with clamp holders 116 being actuated and arrested individually by way of electromechanical devices so that rotary arm 112 is able to accommodate and hold a projectile 9 as well as the desired number of propelling charge modules 10.

In particular, rotary arm 112 may be provided on one side with holding metal sheets 117 primarily for projectiles 9. Thus, when transfer arm 14 rotates up to the gun the heavy weight of the projectile is not only held by clamps 131 but also by metal sheets 117 in case the clamp function of clamps 131 fails. These holding metal sheets are then provided with appropriate recesses 118 for the clamp holders 78 of ammunition transporter 12. Moreover, additional further recesses 119 for transporting claws provided at readiness tray 15 are provided at the bottom of recesses 118.

At its bottom, rotary arm 112 is provided with a standup plate 120 and opposite it a fuse setting coil 121 for setting a projectile fuse 122. Fuse setting coil 121 is arranged to be displaceable over a stroke 123 in the longitudinal direction of rotary arm 112, with the stroke corresponding to the length of the projectile 9 to be picked up by rotary arm 112.

Figure 8:
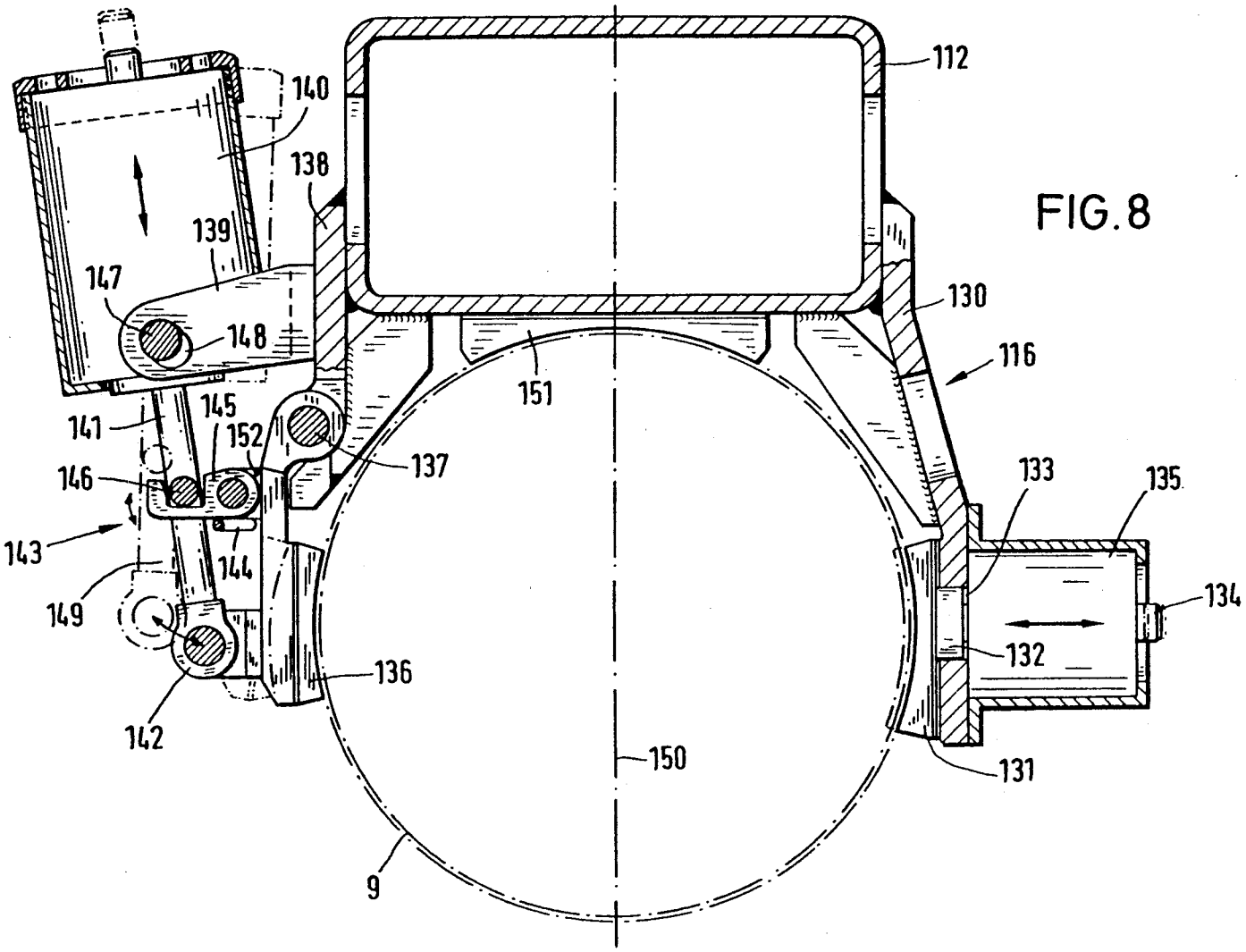
FIG. 8 is a top view of a holding clamp for ammunition in accordance with the invention.

Similarly configured clamp holders are shown in FIGS. 6, 7 and 8. The clamp holders in FIG. 8 include on one side a supporting element 130 which is fixed to the rotary arm and carries a stationary holding clamp 131 having a pin 132 which is guided in a corresponding recess 133 in supporting element 130. Supporting element 130 is connected with a lifting magnet rod 134 which is held in its maximum retracted position by one of the lifting magnets 135 disposed o the exterior of supporting element 130 when magnet 135 is excited. Stationary holding clamp 131 is curved to approximate the radius of projectile 9 and of propelling charge module 10, respectively.

Opposite the stationary holding clamp 131, a pivotally movable holding clamp 136 is fastened by way of a rotary bearing 137 to a supporting element 138 that is fixed to rotary arm 112. Supporting element 138 supports a pivot bearing 139 for a lifting magnet 140. Lifting magnet 140 is provided with a lifting magnet rod 141 equipped with an eye 142 that is rotatably connected with the movable holding clamp 136. By exciting lifting magnet 140, the movable holding clamp 136 can be pivoted back to the maximum open position.

Movable holding clamp 136, which on its interior is likewise curved to approximate the radius of projectile 9 and propelling charge module 10, respectively, is further provided with a spring tensioned mechanical securing member 143 that includes a claw 145 which is pre-tensioned by a spring 144 in the direction toward lifting magnet 140 and can be brought into engagement with a securing pin 146 of lifting magnet rod 141. Pivot bearing 139 receives a rotary pin 147 attached to lifting magnet 140 in a long hole 148 that is oblique to the axis of the lifting magnet rod.

In the closed state of holding clamp 136, claw 145 pushes rotary pin 147 by way of securing pin 146 in long hole 148 in contact with the side facing away from eye 142 and thus locks holding clamp 136 in the closed position, that is, the position in which it is in contact with the ammunition. When holding clamp 136 is opened, rotary pin 147 moves in long hole 148 to contact the side facing eye 142 so that securing pin 146 is able to freely move relative to the mechanical securing member 143 due to the provision of play 149 between the claw opening and securing pin 146.

The ammunition is pivoted in at an angle of approximately 15° relative to the transverse axis 150 of rotary arm 112 and comes to lie against one or several contact faces 151 of rotary arm 112 and at holding clamp 131. While holders 78 of ammunition transporter 12 are still holding the ammunition, lifting magnet 140 is activated and closes holding clamp 136, causing securing pin 146 to enter into the spring tensioned mechanical securing member 143 which leaves its support at 152. Holding clamp 131 is pressed on, while holders 78 of ammunition transporter 12 open and its feed arm 71 moves back. Closing of holding clamps 131 and 136 generally causes the ammunition to be centered on stand-up plate 120. If this centering does not occur, the ammunition is nevertheless held safely by the contact pressure of lifting magnets 135 and 140 and the existing circumferential angle of the two holding clamps 131 and 136 which is greater than 180°.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A redundant ammunition flow device for supplying divided, large caliber ammunition, composed of a projectile and a propelling charge column including a plurality of propelling charge modules, to a loading tray of a gun that is mounted on a turret of a vehicle for adjustment in elevation about a trunnion, the vehicle having a chassis, comprising:

at least two magazines disposed in the chassis of the vehicle, each said magazine having a form of a closed loop and including a plurality of first identical holders each of which is adapted to accommodate in an upright position either the projectile or the propelling charge column and which can be placed in a transfer position;

a lower guide having a form of a ring segment and fixed to the chassis so that said lower guide is concentric with an axis of rotation of the turret;

an upper guide having a form of a ring segment and fixed to a race ring flange of the turret so that said upper guide is concentric with the axis of rotation of the turret;

two ammunition transporters mounted for displacement on said upper and lower guides each transporter for receiving at a respective transfer position either the projectile or the propelling charge column from a respective one of the first holders, each said ammunition transporter including a first rotary arm and a feed arm held by said first rotary arm and including second holders for holding the projectile or the propelling charge column;

two ammunition transfer arms operatively arranged for receiving either the projectile or the propelling charge column from a respective one of said ammunition transporters, one said ammunition transfer arm disposed on each side of the gun and each said ammunition transfer arm being pivotal about the trunnion and including a lifting arm having third holders for picking up and lifting the projectile or propelling charge column; and two readiness trays operatively arranged for receiving either the projectile or the propelling charge column from a respective one of said ammunition transfer arms, with one of said readiness trays being disposed on each side of the loading tray.

2. A device as defined in claim 1, wherein the vehicle has a longitudinal center axis and said magazines each have a form of an elongate loop arranged parallel to the longitudinal center axis of the vehicle.

3. A device as defined in claim 1, wherein said first identical holders are adapted for holding projectiles and propelling charge columns in an alternating arrangement within each said magazine.

4. A device as defined in claim 1, wherein each said ammunition transporter includes a carriage supporting said first rotary arm and in engagement with said lower guide for being guided by said lower guide.

5. A device as defined in claim 1, wherein said upper guide has a form of a ring segment and is fixed relative to said lower guide, wherein each ammunition transporter has a top end and a running head at the top end that is in engagement with said upper guide.

6. A device as defined in claim 1, further comprising guide sleeves attached to each said first rotary arm and guide rods attached to each said feed arm and accommodated in a respective one of said guide sleeves for guiding a respective one of said feed arms when displaced relative to said first rotary arm.

7. A device as defined in claim 1, wherein each said ammunition transfer arm includes a holding arm which carries said lifting arm and has a toothed segment for operative engagement with a pinion for causing rotation of said ammunition transfer arm about the trunnion.

8. A device as defined in claim 7, wherein each said lifting arm includes a fuse setting coil for setting a fuse of the projectile carried by said lifting arm.

9. A device as defined in claim 7, wherein each said ammunition transfer arm further includes a second rotary arm rotatably mounted on said lifting arm, said third holders being carried by said second rotary arm.

10. A device as defined in claim 7, wherein said lifting arm is mounted for displacement in a longitudinal direction of said holding arm.

11. A device as defined in claim 1, wherein said first, second and third holders each comprise clamp holders for clamping respective ones of the propelling charge modules of a propelling charge column.

* * * * *